US007316192B2

(12) United States Patent
Thomas

(10) Patent No.: US 7,316,192 B2
(45) Date of Patent: Jan. 8, 2008

(54) METHOD FOR MOUNTING A HEAVY EQUIPMENT ON A SHIP'S HULL

(75) Inventor: Pierre-Armand Thomas, Puteaux (FR)

(73) Assignee: Technip France (FR)

( * ) Notice: Subject to any disclaimer, the term of this patent is extended or adjusted under 35 U.S.C. 154(b) by 0 days.

(21) Appl. No.: 10/499,771

(22) PCT Filed: Nov. 28, 2002

(86) PCT No.: PCT/FR02/04098

§ 371 (c)(1),
(2), (4) Date: Jun. 21, 2004

(87) PCT Pub. No.: WO03/055739

PCT Pub. Date: Jul. 10, 2003

(65) Prior Publication Data

US 2005/0013667 A1 Jan. 20, 2005

(30) Foreign Application Priority Data

Dec. 24, 2001 (FR) ..... 01 16835

(51) Int. Cl.
*B63B 9/06* (2006.01)

(52) U.S. Cl. ..... 114/65 R; 405/204

(58) Field of Classification Search ..... 114/265, 114/264, 65 R, 267; 405/196, 195.1, 204–209, 405/203

See application file for complete search history.

(56) References Cited

U.S. PATENT DOCUMENTS

| | | | | |
|---|---|---|---|---|
| 2,210,408 | A * | 8/1940 | Henry | 405/196 |
| 3,138,932 | A * | 6/1964 | Kofahl et al. | 405/209 |
| 4,156,577 | A * | 5/1979 | McMakin | 405/196 |
| 4,928,616 | A * | 5/1990 | Robishaw et al. | 114/267 |
| 5,190,410 | A | 3/1993 | Nunley | |
| 6,293,734 | B1 | 9/2001 | Oudin | |

FOREIGN PATENT DOCUMENTS

JP 61-28614 * 2/1986

OTHER PUBLICATIONS

International Search Report dated Apr. 3, 2003.

* cited by examiner

*Primary Examiner*—Ed Swinehart
(74) *Attorney, Agent, or Firm*—Ostrolenk, Faber, Gerb & Soffen, LLP

(57) ABSTRACT

The invention concerns a method for mounting a heavy equipment on a floating ship's hull comprising the following steps: (A) securing the equipment to lifting units adapted to be supported on the sea floor, said lifting units being arranged on either side of the equipment; (B) pressing the lifting units on the sea floor; (C) lifting the equipment to shift the ship's hull beneath the equipment; (D) cause the ship's hull to be engaged beneath the equipment in the space defined between the lifting units; (E) lowering the equipment to set it in supported position on the ship's hull; (F) dismantling the units for lifting the equipment; and (G) connecting the equipment to the ship's hull.

7 Claims, 9 Drawing Sheets

METHOD FOR MOUNTING A HEAVY EQUIPMENT ON A SHIP'S HULL

BACKGROUND OF THE INVENTION

The present invention relates to a method for amounting a heavy equipment on a floating ship's hull. It also relates to an equipment prepared for the implementation of the method.

In the oil industry, it is known to moor, above an oilfield, a ship for the collecting, processing, temporary storage and off-loading of hydrocarbons. The hull of the ship is used for the storage of the hydrocarbons. The ship comprises on its deck an installation for processing the collected crude oil before the processed hydrocarbons are sent into the tanks provided in the hull of the ship. Such a ship is commonly referred to by the acronym "FPSO", standing for the English expression "Floating Production, Storage and Off-loading".

For the manufacture of such a ship, it is frequent that the hull and the tanks that are contained in it are manufactured on a first construction site and that the installation intended to be installed on top of the hull is manufactured on a second construction site remote from the first site.

Hulls of this type of ship have very large dimensions. Their length varies approximately from 200 to 400, their width from 35 to 70 m, with the total height of the hull varying from 30 to 45 m.

The installations that have to be mounted on the ship's hull typically have a total weight greater than 20,000 tonnes.

To enable their putting into position, and because of the lifting difficulties resulting from the very large dimensions of the hull, it is known to manufacture the production installation in the form of modules having a unit weight typically of the order to 1000 to 2500 tonnes. Each of the modules is pre-assembled on the ground and is then put into position on the ship with the help of handling means such as: land crane, floating crane, traveling-gantry crane, etc.

The installation that has to be mounted in the hull is thus broken down into modules that are pre-assembled on the ground. The modules are successively put into position on the ship's hull and then the fluid conveying connections, the electrical power and data transfer links are established between the different modules, on the one hand, and between the modules and the ship's hull on the other hand. Furthermore, the connections to the crude hydrocarbon pipes, on the one hand, and to the pipes for the dispatch of the preprocessed products, on the other hand, are established.

The time of assembly of the installation on the ship's hull is relatively long since a large number of modules must be placed successively on the deck and then these modules must be interconnected.

SUMMARY OF THE INVENTION

The purpose of the invention is to propose a method for putting a heavy equipment into position on a ship's hull which saves time and rationalizes the overall manufacture of the equipped ship.

For this purpose, the invention relates to a method for mounting a heavy equipment on a floating ship's hull, characterized in that it comprises the following steps:

A—securing the equipment to lifting units adapted to bear on the seabed, these lifting units being arranged on either side of the equipment;

B—applying the lifting units onto the sea floor;

C—lifting the equipment to allow the ship's hull to pass under the equipment;

D—engaging the ship's hull beneath the equipment in the space defined between the lifting units;

E—lowering the equipment to place it such that it is bearing on the ship's hull;

F—dismantling the equipment lifting units; and

G—connecting the equipment to the ship's hull.

Depending on the particular modes of implementation, the method comprises one or more of the following characteristics:

- it comprises a step of installation of the equipment on a barge, before applying the lifting units onto the seabed, a step of separation of the equipment and the barge during the lifting of the equipment and a step of disengagement of the barge after the lifting of the equipment;
- it comprises a step of putting into position of a set of foot-pieces at the bearing points of the lifting units on the seabed, these foot-pieces having lateral surfaces for guiding the ship's hull;
- it comprises a step of securing a set of equipment rigidifying elements to form a rigid structure between the lifting units, at least during the lifting and the lowering of the equipment, and a step of releasing the rigidifying elements in order to provide the equipment with increased flexibility after depositing the equipment on the ship's hull;
- each lifting unit comprises a leg equipped with a rack, this leg being intended to bear down upon the seabed and a leg guidance and driving device, mounted in a detachable manner on the equipment, this device comprising at least one pinion meshed with the rack and a motor reduction unit for driving the pinion in order to move the leg with respect to the guidance and driving device.

The invention also relates to a heavy equipment prepared for the implementation of the method such as defined above characterized in that it comprises:

- an equipment to be mounted in the ship's hull;
- equipment lifting units adapted to bear on the seabed;
- means of temporary connection of the equipment lifting units on either side of the equipment with a spacing allowing the passage of the ship's hull between the lifting units.

Possibly, the prepared equipment comprises a set of elements for rigidifying the equipment, and releasable means of securing the rigidifying elements so that the equipment forms a rigid structure when the securing means are providing the structural integrity of the elements thus rigidified.

The invention will be better understood on reading the following description, given solely by way of example and with reference to the drawings, in which:

BRIEF DESCRIPTION OF THE DRAWINGS

The invention will be better understood on reading the following description, given solely by way of example and with reference to the drawings, in which.

DESCRIPTION OF A PREFERRED EMBODIMENT

The method that will be described is intended in particular for the mounting of equipment in the manufacturing processes of ships for the oil industry. The completed ship comprises a production installation on its hull. This production installation is typically broken down into a processing equipment and an auxiliary equipment providing services, in particular energy to the processing equipment. Each equipment consisting of interconnected zones or modules, each one having a specific function.

In order to mount the production installation on the ship's hull, all of the elements are assembled together on shore in order to form a unique equipment constituting the entire installation if the dimensions and the total weight (less than 18 000 tonnes for example) of the installation permit this. This equipment is then put into position directly on the ship's hull according to the described method.

If the assembly of elements constituting the production installation has dimensions and/or weight that is too great (weight greater than 18 000 tonnes for example), the elements are divided into two equipments, for example one equipment for the processing and one auxiliary equipment for the auxiliary functions supplying services, each equipment having dimensions and weight making the use of the method possible.

Each equipment is pre-assembled on the ground and is then mounted directly on the hull.

For the mounting of the complete installation on the hull, the steps of the method used for the first equipment are reproduced for the second equipment.

Figure 1:
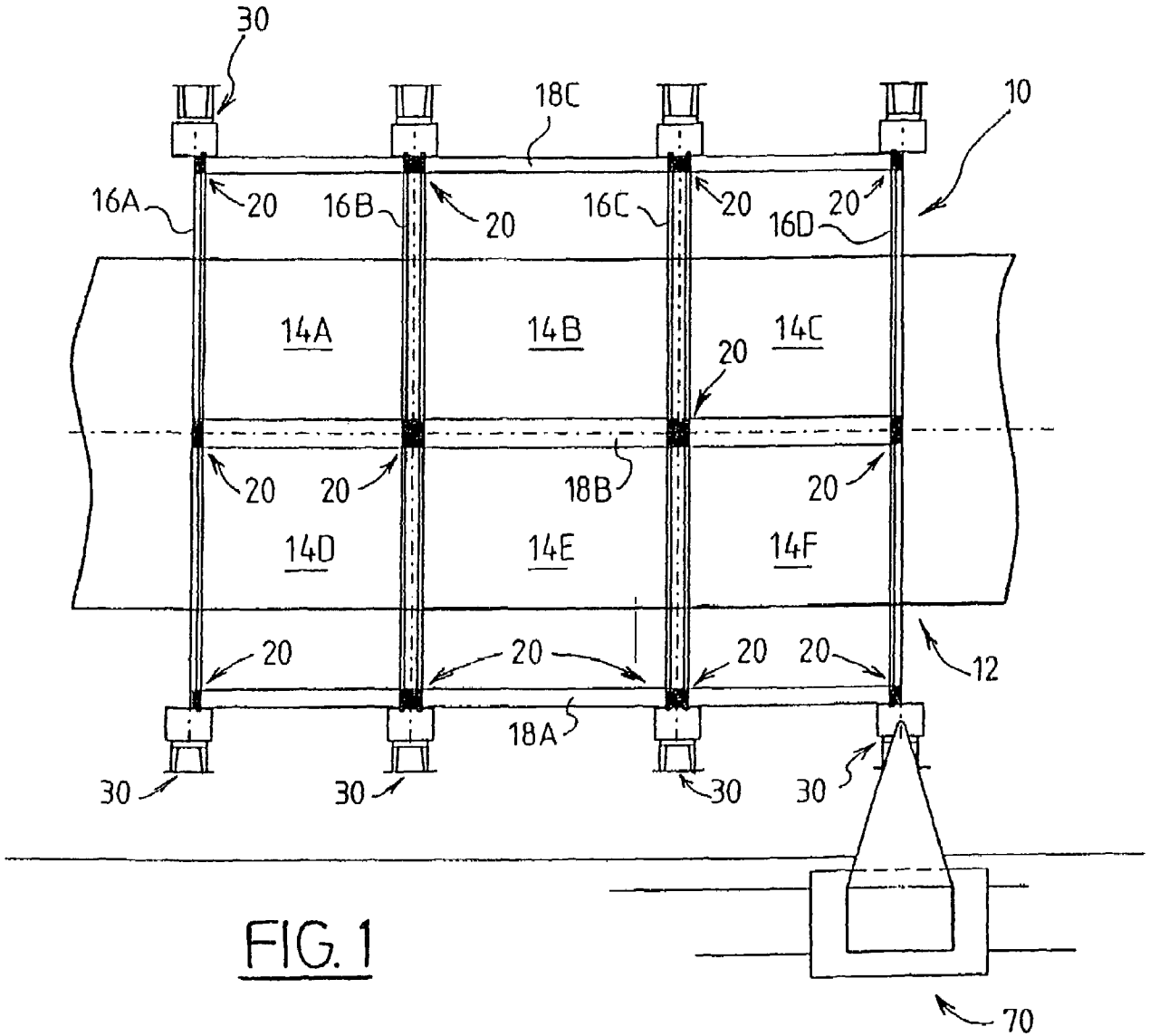
FIG. 1 is a plan view of the heavy equipment standing on a barge or transport ship, before mounting on the ship's hull.

Such an equipment is shown in FIG. 1 and is indicated by the general reference 10.

The equipment 10 is initially pre-assembled on the ground and is tested there in order that it is able to implement the functions for which it was designed.

This equipment stands on a transport barge 12. The equipment 10 consists of an assembly of production elements distributed in different zones. For example, as shown in the appended figures, it can consist of six zones 14A, 14B, 14C, 14D, 14E, 14F, disposed in two lines and three columns. The elements of a same zone are connected to each other and the elements of the different modules are connected to each other by fluid conveying pipes, electric power conductor wires and data transfer wires.

The equipment 10 furthermore comprises rigidifying members such as beams distributed between the zones. Along the length, the equipment 10, such as the example shown in the figures, comprises four transverse rigidifying beams 16A, 16B, 16C and 16D, substantially equidistant from each other. These beams are each constituted by two beam sections assembled with each other in a temporary manner in the median region of the equipment.

Similarly, along its length, the equipment comprises three longitudinal beams 18A, 18B and 18C, each constituted by three beam sections connected to each other by temporary connecting means. These connections are carried out at the points of intersection with the transverse beams 16A, 16B, 16C and 16D. At these points of intersection, the sections of the longitudinal beams and of the transverse beams are connected to each other in order to ensure a rigidifying of the equipment, such that the equipment in itself constitutes a rigid structure.

For reasons of simplification, the temporary connection means of the beam sections are represented by black squares disposed at the points of intersection of the beams. They are indicted by the general reference 20. In practice, the connection means are constituted, for example, by removable pins engaged in coaxial openings in the beam sections or by the continuity of the beams that are subsequently cut.

Initially, the different rigidifying sections constituting the longitudinal and transverse beams are connected rigidly to each other. Thus, the equipment constitutes a rigid structure during its putting into position on the barge 12 and during the subsequent steps of the method. The putting into position of the equipment on the transport barge is carried out for example by sliding from a quay whose height corresponds exactly with the non-immersed height of the barge.

Furthermore, during the initial phase of implementing the method, the equipment 10 is provided, laterally on either side of the barge, with lifting units 30 disposed at the ends of the transverse beams 16A, 16B, 16C and 16D. These lifting units are disposed on either side of the equipment 10 and are distributed along its length in such a way as to rationalize both the arrangement of the zones inside the equipment and the mechanical properties of the assembly.

Figure 2:
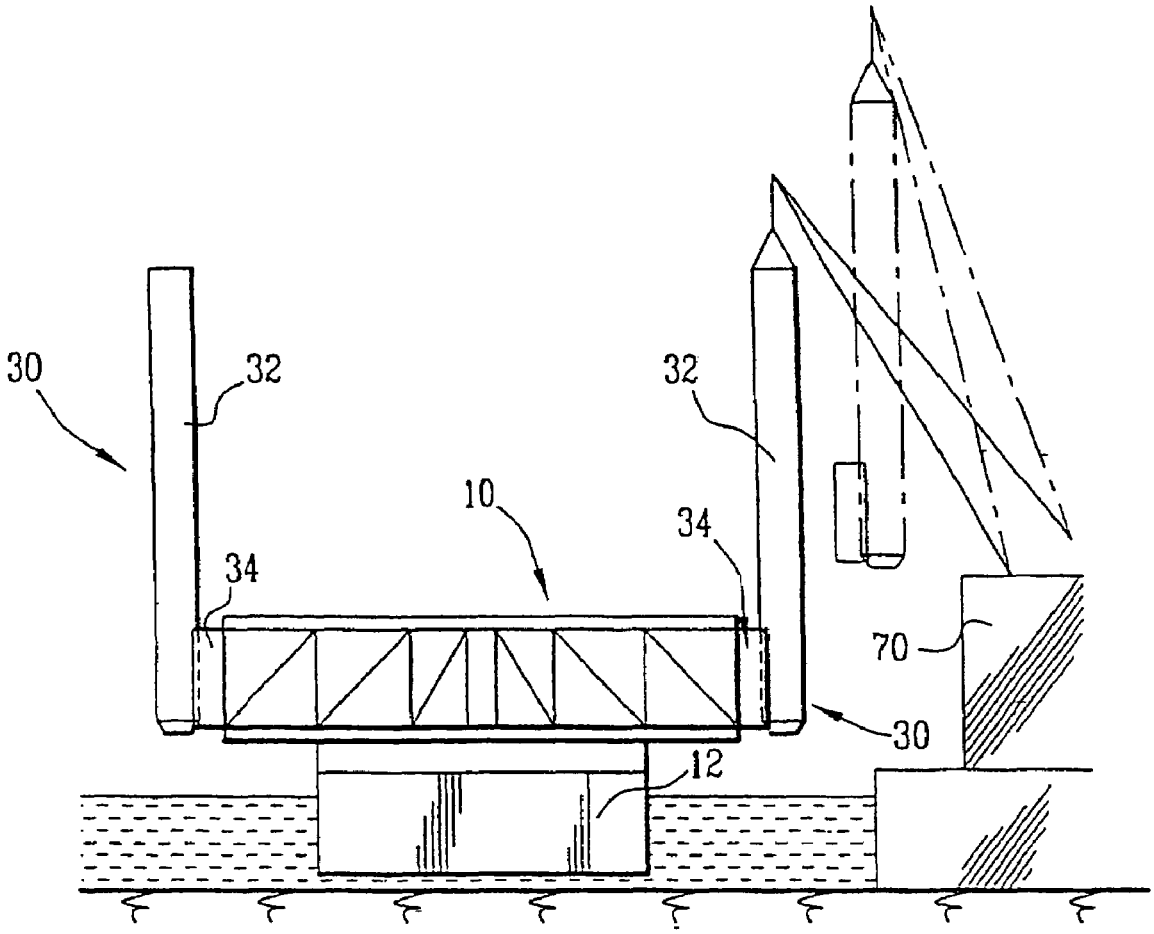
FIG. 2 is a front view of the heavy equipment standing on the transport barge.

Each lifting unit 30 comprises, as shown in FIG. 2, a vertical leg 32 and a guidance and driving device 34 connected in a removable manner to the equipment 10 by temporary connecting means 35.

Figure 3:
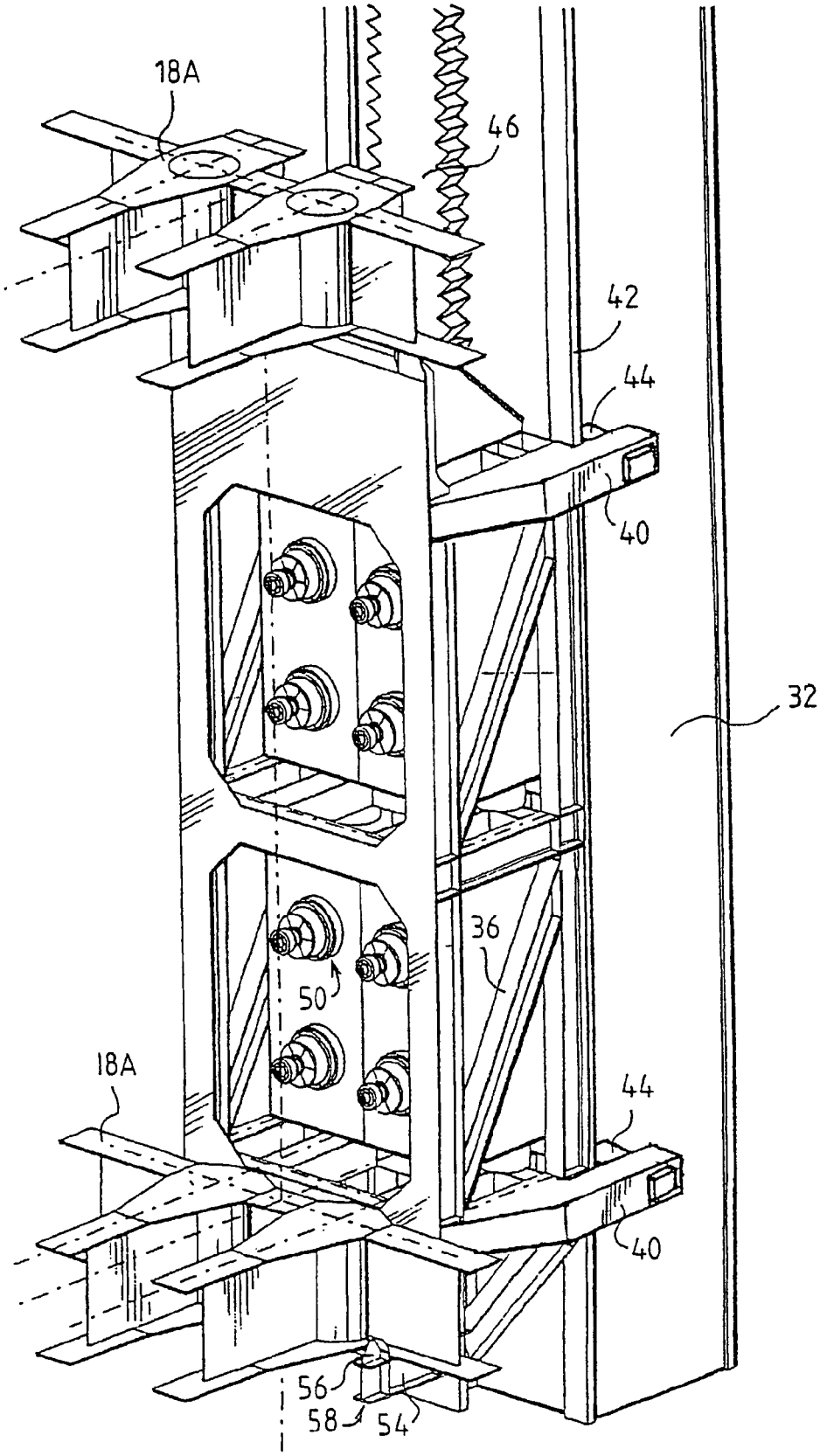
FIG. 3 is a perspective view of a lifting unit secured to the equipment.
Figure 4:
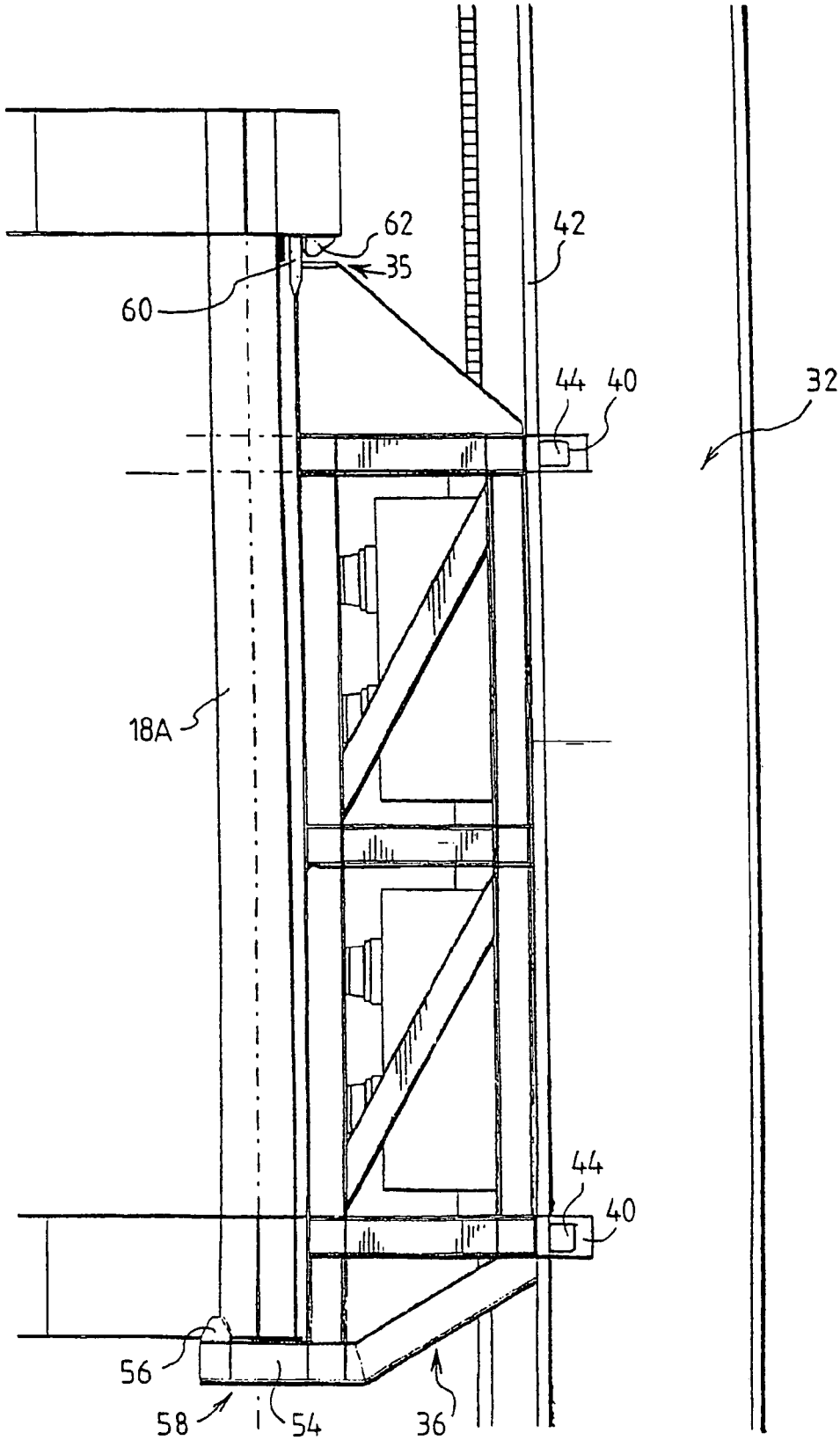
FIG. 4 is a side view of the lifting unit shown in FIG. 3.
Figure 5:
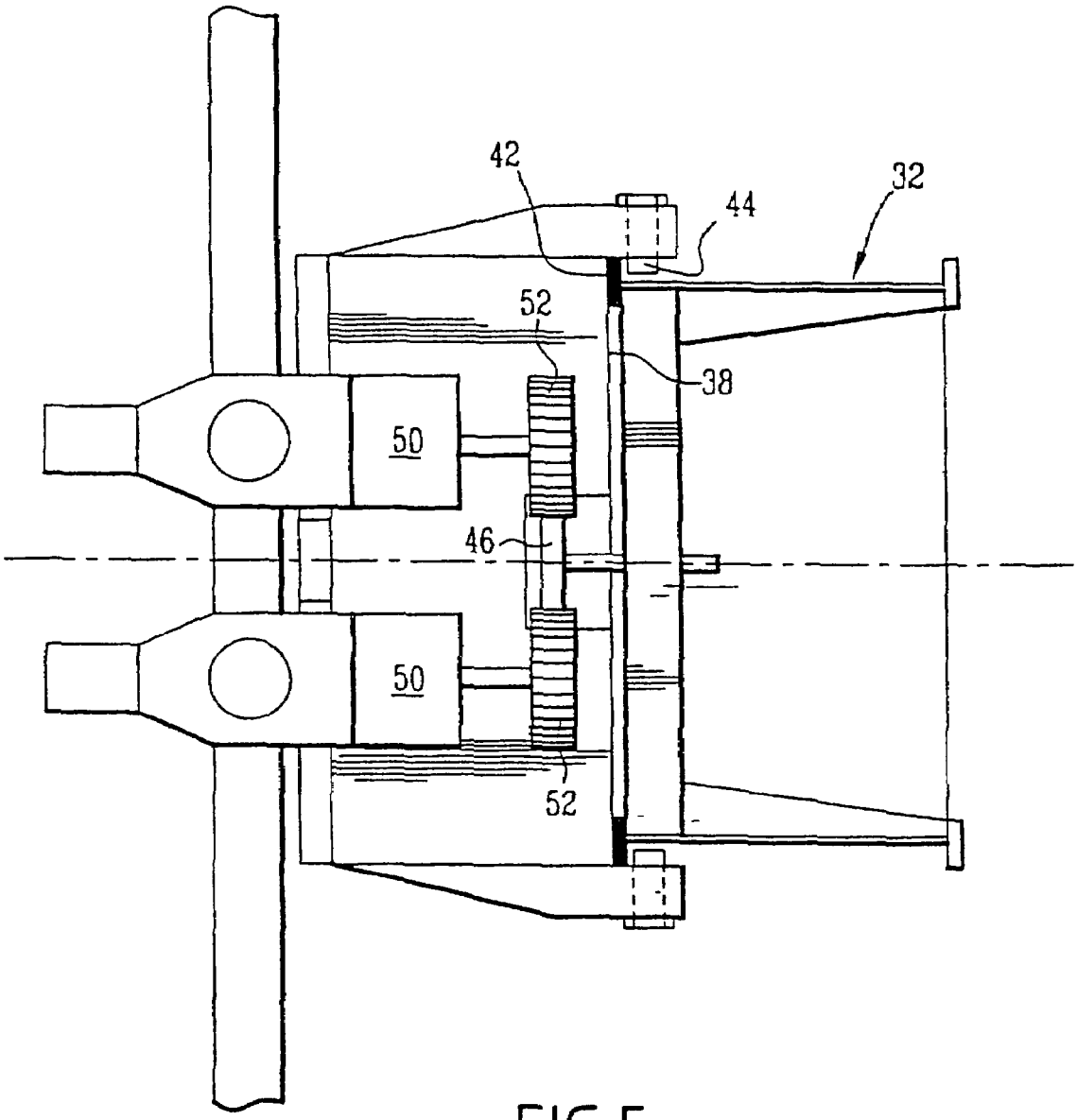
FIG. 5 is a cross-sectional view of the lifting unit shown in FIGS. 3 and 4.

The lifting units 30 are each adapted to be mounted only temporarily on the mobile equipment. A lifting unit is shown in detail in FIGS. 3, 4 and 5. The leg 32 shown here has a rectangular-shaped cross-section, it must be such that its geometrical and mechanical characteristics allow the transmission of the guidance and lifting forces.

The guidance and driving device 34 consists of a trellis structure 36 extending vertically over the whole height of the equipment. This trellis structure 36 defines a vertical reference surface 38 for the leg 32. It furthermore comprises four arms 40 disposed at the ends of the reference surface and protruding with respect to the latter. These arms are disposed at the four corners of a rectangle and provide lateral guidance of the leg 32.

The leg 32 has, laterally on either side, rails 42 applied against the reference surface 38. These rails protrude laterally with respect to the sides of the leg. Removable pins 44 engaged through the ends of the arms 40 ensure the holding of the leg against the reference surface 38 by keeping the rails 42 clamped between the reference surface 38 and the pins 44.

Each leg 32 comprises a double rack 46 extending vertically along the height of the leg in the median part of the latter. This rack is engaged inside the trellis structure 36 of the guidance and driving device 34. The latter comprises between four eight motor reduction units 50 distributed on both sides of the rack over the height of the latter. These motor reduction units 50 provide the driving of pinions 52 meshed with the double rack 46 on both sides.

The means 35 of holding the lifting unit are formed, on the one hand, on the guidance and driving device 34 of the leg and, on the other hand, on the lateral side of the equipment 10.

These holding means 35 comprise, in the lower part of the guidance and driving device 34, a horizontal beam 54 equipped with a stud 56 at its end, the stud pointing towards the upper end of the device 34. The beam 54 and the stud 56 together form a crook 58 able to be engaged beneath a girder delimiting the longitudinal beam, for example 18A.

At its upper end, the trellis structure 36 has a retaining lug 60 held clamped against the lateral edge of the equipment and a shoe-piece 62 forming a stop. The lug 60 upwardly extends the trellis structure 36. The crook 58 and the lug 60 cooperating with the lower girder of the equipment and the shoe-piece 62 ensure an engagement of the device 34 and the equipment. The effective holding is provided by lashing.

The lifting units 30 are put into position on the equipment using a crane 70 standing on the quay, as shown in FIG. 1, whilst the equipment is already standing on the barge.

For this purpose, the guidance and driving devices 34 are firstly installed on the legs 32. The legs are engaged between the arms 34 and the retaining pins 44 are put into position in order to ensure the securing together of the legs 32 and the guidance and driving units 34.

Each lifting unit is then suspended from the crane and moved along the equipment using the guidance and driving device 34 disposed at a level that is lower than its final level.

The assembled lifting unit 30 is then brought close to the equipment and is then raised in such a way that the crook 58 becomes engaged under the longitudinal beam of the equipment and that the retaining lug 60 is received between the external surface of the beam 198A and the shoe-piece 62. The trellis structure 36 is then temporarily lashed to the rigidifying beam of the equipment in order to ensure their connection.

As a variant, and depending on the available lifting means, the lifting unit 30 can be installed in two sections. The guidance units 34 are installed firstly on the equipment and then the legs 32 are engaged in the guidance units.

Initially, the legs are raised and are held clear of the water, as shown in FIG. 2.

Figure 6:
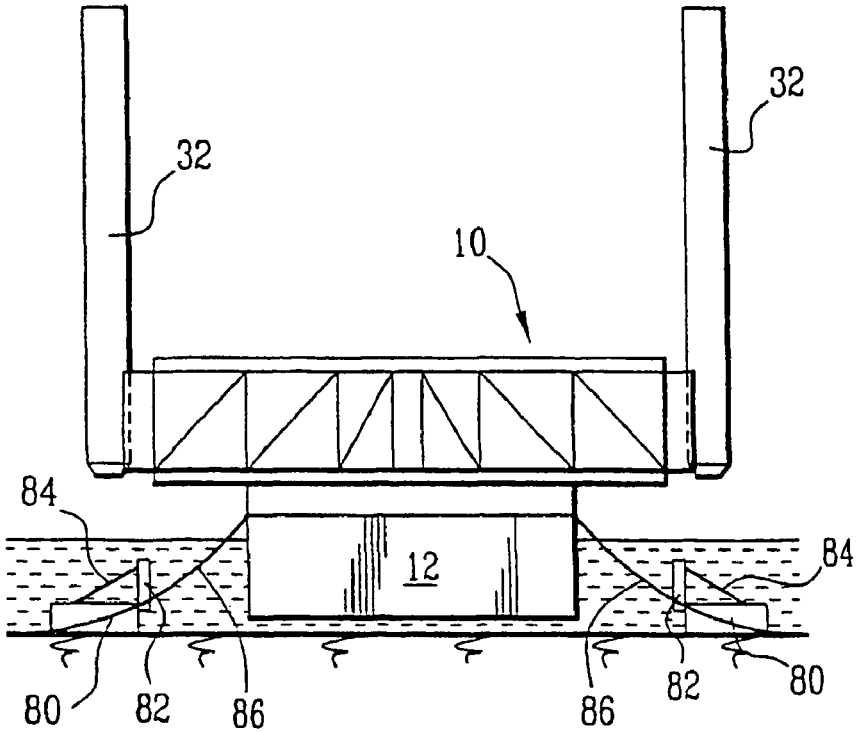
FIG. 6 is an end view of the equipment carried by the barge having arrived at the mounting site.

When the equipment is thus prepared for its installation on the ship's hull, the barge transporting the equipment is taken to the site of transfer of the equipment from the barge to the ship's hull. This site is previously equipped, as shown in FIG. 6, with a set of foot-pieces 80 standing on the seabed in the places where the lower ends of the legs 32 must stand on the seabed after having been lowered.

As a variant, and depending on the properties of the seabed, the foot-pieces are secured to the legs before the operation.

Vertical panels 82 for guiding the ship's hull are integral with the foot-pieces 80.

They are disposed such that the gap defined between two opposite panels is equal to the width of the hull plus a tolerance for the effective passage of the latter.

These panels are retained by stays 84 on the foot-pieces 80.

As shown in FIG. 6, the barge 12 is engaged between the foot-pieces 80 and is moored by anchorings 86 in such a way that the legs 32 are above the previously installed foot-pieces 80.

Figure 7:
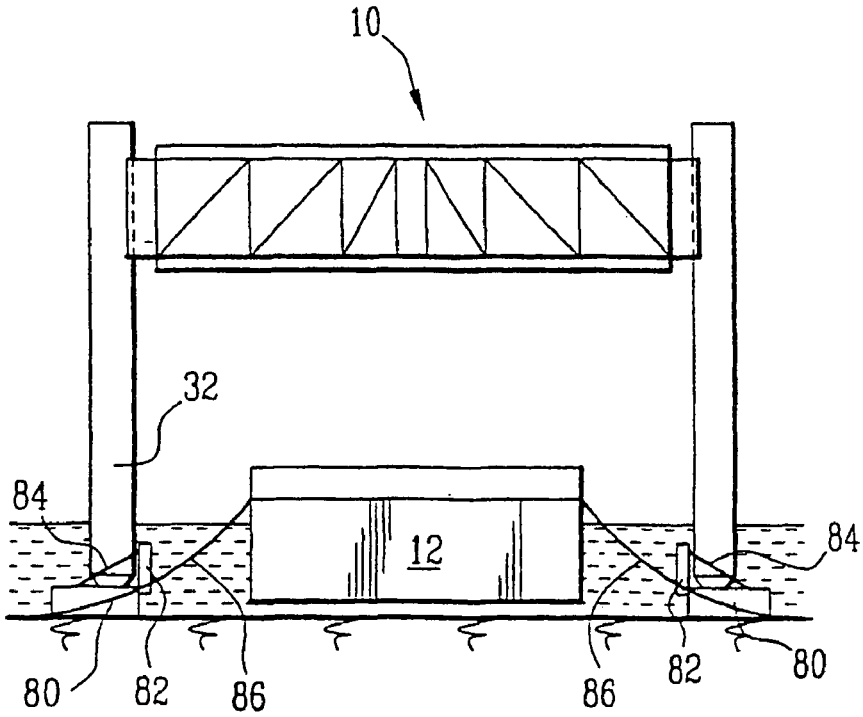
FIG. 7 is an end view of the equipment raised above the barge and bearing on the seabed.

As shown in FIG. 7, the legs 32 are then lowered until they bear on the foot-pieces 80 after which the equipment 10 is lifted over the height of the legs up to a height sufficient for the passage of the ship's hull to be equipped.

Figure 8:
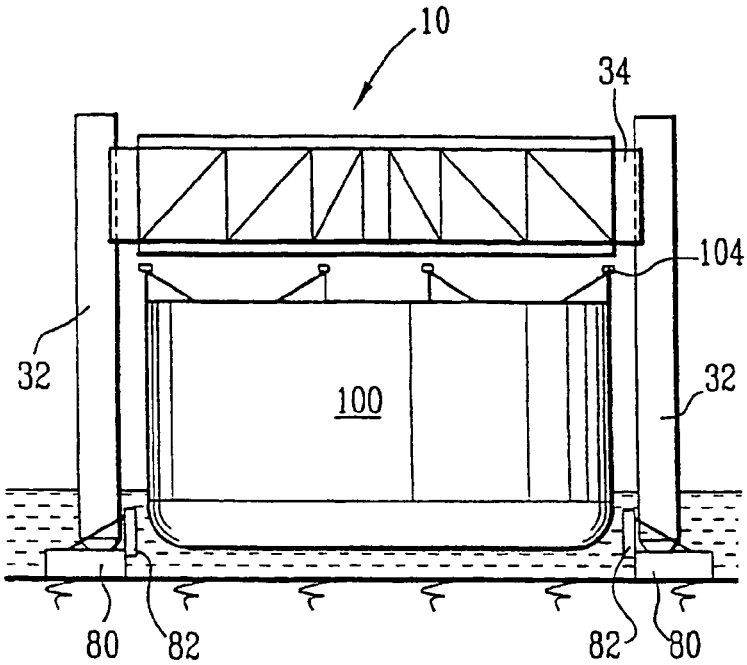
FIG. 8 is an end view of the raised equipment with the ship's hull being engaged below the equipment.
Figure 9:
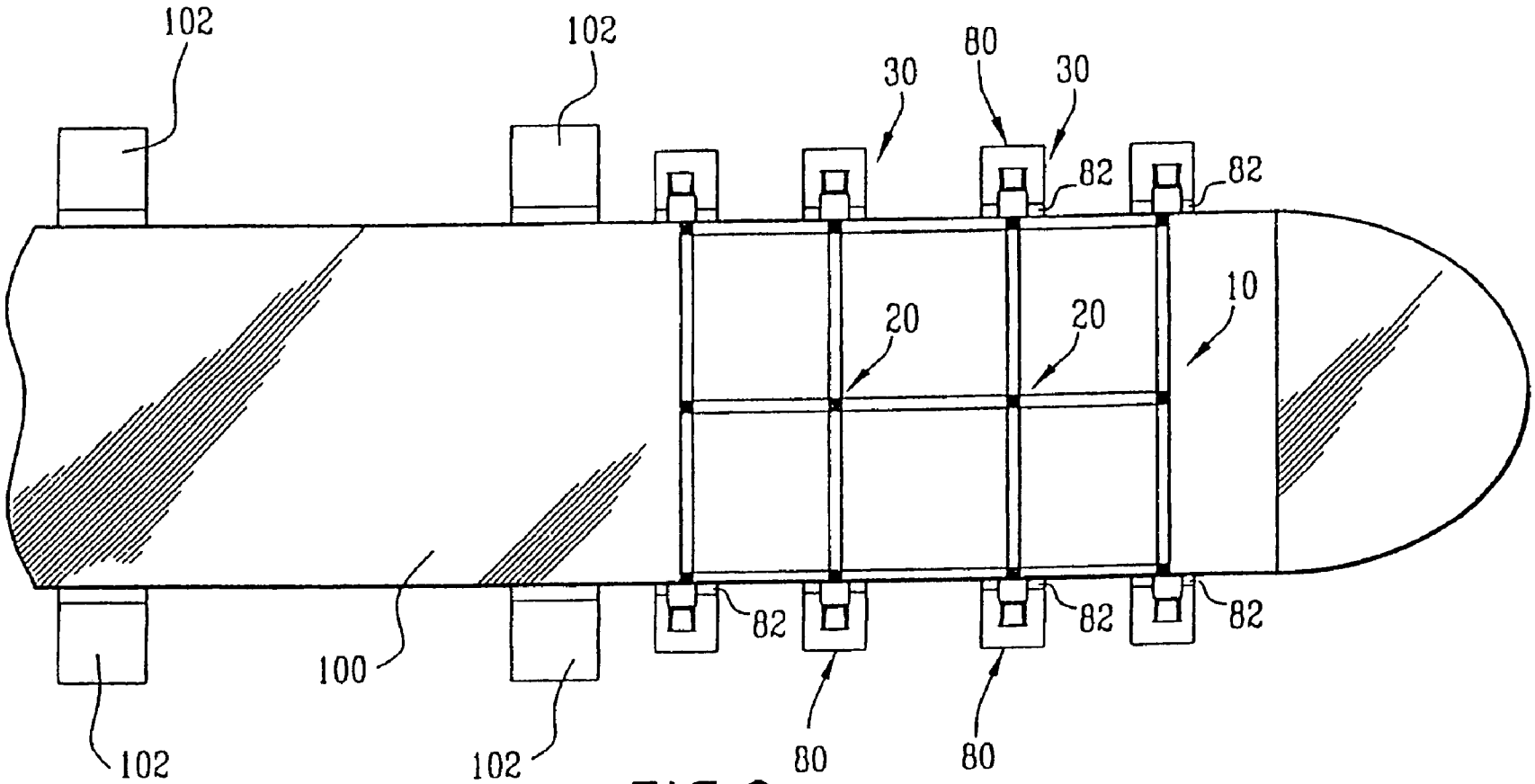
FIG. 9 is a plan view of the ship's hull engaged below the equipment to be installed.

During the lifting of the equipment 10, the latter becomes detached from the barge. The barge is then disengaged from the bottom of the equipment 10 and the hull, referenced 100, of the ship to be equipped is engaged below the equipment 10, as shown in FIGS. 8 and 9.

During the engagement of the hull, the panels 82 attached to the foot-pieces provide lateral guidance for the ship's hull.

Preferably, guidance pillars for the ship's hull are disposed in alignment with the foot-pieces 80 in order to provide lateral guidance for the hull over its entire length.

Before putting the equipment into position, the hull 100 is equipped with supports 104 for the equipment to bear upon.

Figure 10:
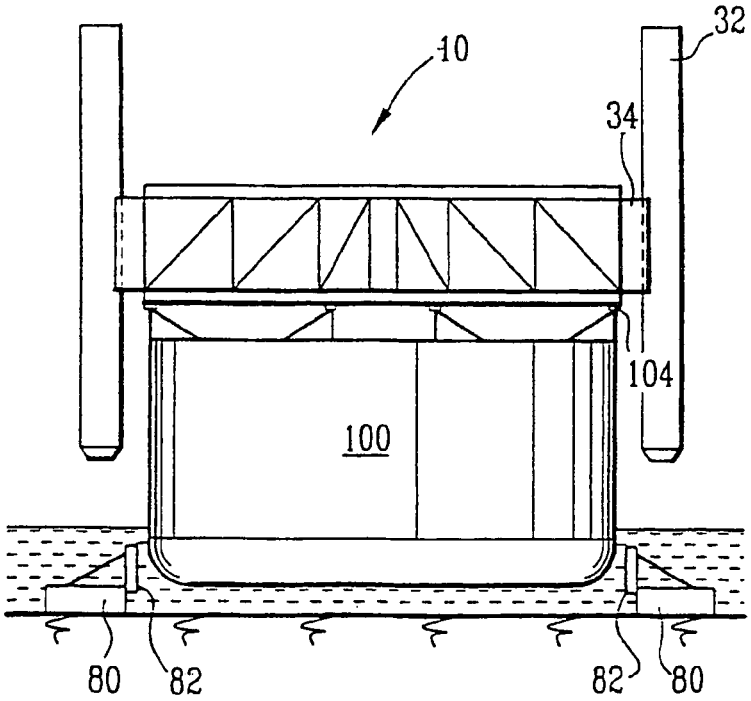
FIG. 10 is an end view of the equipment standing on the ship's hull after raising the legs.

When the ship's hull is correctly positioned with respect to the equipment to be installed, the equipment is lowered in such a way that it comes to bear on the supports 104 as shown in FIG. 10.

Throughout the entire handling of the equipment 10, the latter behaves like a single rigid structure due to the temporary connections. Thus, deformations of the equipment are also reduced as much as possible during its transport, its lifting and its lowering for its putting into position on the ship's hull.

Figure 11:
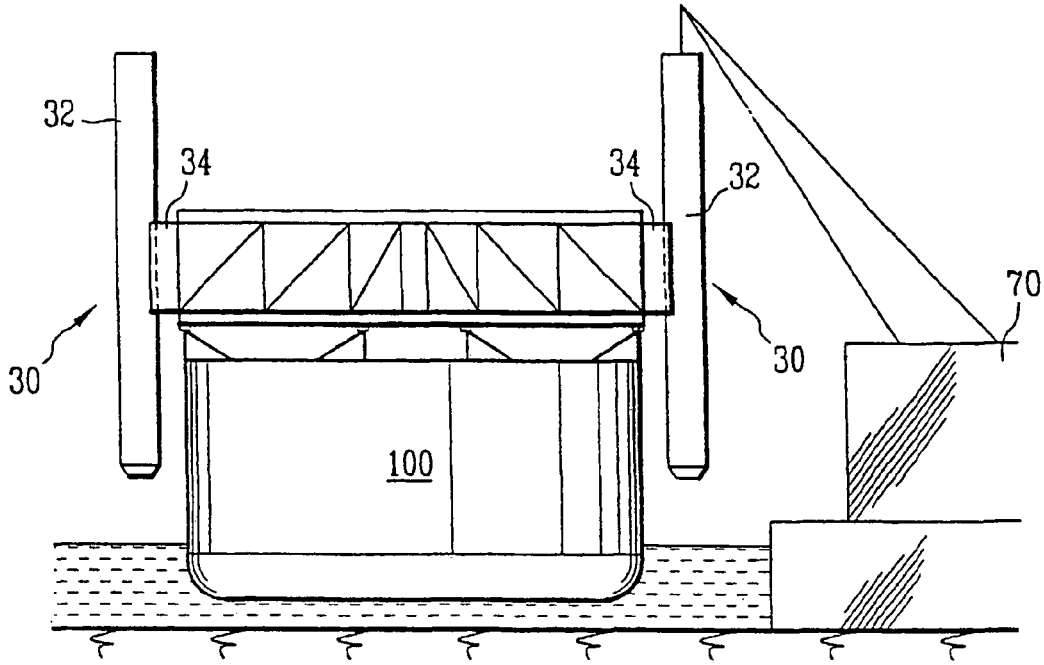
FIG. 11 is an end view of the equipment standing on the ship's hull during the disassembly of the lifting units.

After the equipment has been positioned correctly on the hull, the legs 32 are lifted, as shown in FIG. 10, and the ship's hull is taken to a quay in order that a crane 70 may dismantle the lifting units 30, as shown in FIG. 11. This dismantling is carried out by the simultaneous withdrawal of the legs and the guidance and driving devices 34 after the connecting lashings have been released.

As a variant, and depending on the lifting means available, the lifting unit 30 can be dismantled in two sections. The legs 32 are firstly disconnected from the guidance units 34 and then the guidance units 34 are disconnected from the equipment.

Figure 12:
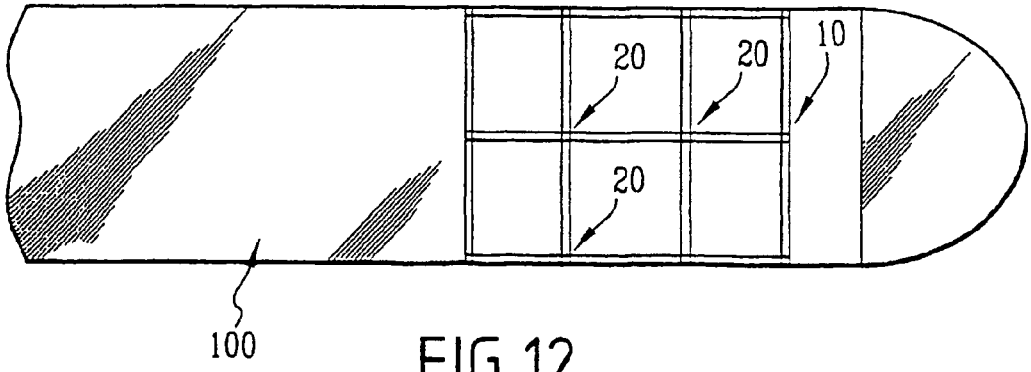
FIG. 12 is a plan view of the ship's hull upon which stands the equipment released from the action of the rigidifying elements.

After the dismantling of the lifting units 30, the various equipment rigidifying sections are detached by releasing the detachable connecting elements 20 disposed at the intersections between the various rigidifying elements, as shown in FIG. 12, where the absence of connection is represented by white squares between the rigidifying sections.

The connections of the pipes and the electrical conductors are then made between the equipment and the ship's hull.

If two equipments have to be put into position on the ship, the second equipment is put into position in a similar way. The connection between the two equipments is then carried out directly on the ship.

It is understood that the method described here makes it possible to put very heavy equipments into position on the ship, such that the ship can be equipped by installing only one of two equipments on it. Thus, the equipments can be almost completely pre-assembled on shore and the time necessary for the connection of the equipments to the ship's hull is reduced, such that the time of complete construction of the ship is reduced.

Furthermore, as the various modules constituting each equipment are mechanically uncoupled from each other after the rigidifying sections have been detached from each other, the equipment installed on the ship's hull is able to deform, module by module, in a way similar to the deformation undergone by the ship whilst sailing. The mechanical structure of the ship is therefore reliable.

In the above description, the lifting units are constituted by legs equipped with racks driven by motor reduction units. However, as a variant:

these lifting units are constituted by legs comprising, along their length, cables attached to the equipment, the displacement of the equipment being provided by drive units fixed to the tops of the legs;

these lifting units are constituted by legs comprising, along their length, step-by-step locking systems, the displacement from one step to another being provided by jacking.

The invention claimed is:

1. A method for mounting a heavy equipment on a floating ship's hull for assembly as an integral unit therewith, comprising the following steps:

A—detachably securing the equipment to lifting units adapted to bear on the seabed, and arranging the lifting units on either side of the equipment, wherein each of the lifting units includes a vertical leg, a guidance and driving unit operable to lift and lower the vertical leg, and a temporary connector operable to removably connect the guidance and driving unit to the equipment; the step of detachably securing the equipment comprises removably connecting the guidance and driving unit of each lifting unit to the equipment using the temporary connector;

B—applying the lifting units onto the sea floor;

C—lifting the equipment to allow the ship's hull to pass under the equipment;

D—engaging the ship's hull beneath the equipment in a space defined between the lifting units;

E—lowering the equipment to place it such that it is bearing on the ship's hull;

F—dismantling and removing the equipment lifting units comprising removing the temporary connector of each lifting unit and disconnecting the guidance and driving unit from the equipment;

G—attaching the equipment to the ship's hull to form the integral unit therewith; and H—securing a set of equipment rigidifying elements to form a rigid structure between the lifting units, the securing being at least during the lifting and the lowering of the equipment, and releasing the rigidifying elements in order to provide the equipment with increased flexibility after the depositing of the equipment on the ship's hull.

2. The method as claimed in claim 1, further comprising steps of installing the equipment on a barge, before applying the lifting units onto the seabed, separating the equipment and the barge during the lifting of the equipment, and disengaging the barge after the lifting of the equipment.

3. The method as claimed in claim 1, further comprising positioning a set of foot-pieces at the bearing points of the lifting units on the seabed, and guiding the ship's hull against lateral surfaces of the foot-pieces while engaging the ship's hull in the space between the lifting units.

4. The method as claimed in claim 1, wherein each lifting unit is applied onto the sea floor by a leg equipped with a rack, the leg being configured and positioned to bear down upon the seabed; moving the leg by engaging the rack with a pinion detachably mounted on the equipment and driving the pinion by a motor reduction unit also detachably mounted on the equipment.

5. Apparatus for mounting a piece of equipment on a ship's hull for integral assembly therewith comprising:

a piece of equipment to be mounted in the ship's hull, the piece of equipment having a plurality of sections;

a set of rigidifying elements including at least one rigidifying transverse beam temporarily secured between the sections of the piece of equipment, at least one rigidifying longitudinal beam temporarily secured between the sections of the piece of equipment, the rigidifying transverse beam intersecting the rigidifying longitudinal beam:

a releasable connector temporarily connecting the at least one rigidifying transverse beam to the at least one rigidifying longitudinal beam at a point of their intersection such that the sections of the piece of equipment form a rigid structure at least during lifting of the piece of equipment; and equipment lifting units positioned at ends of the at least one rigidifying transverse beam and adapted to bear on the seabed, the lifting units including attaching elements constructed and configured for temporary attachment to the piece of equipment to allow lifting the piece of equipment above the hull and lowering the piece of equipment onto the hull, the lifting units being configured and positioned to provide clearance for receiving the ship's hull therebetween while the piece of equipment is being mounted on the hull; wherein each equipment lifting unit includes a vertical leg, a guidance and driving unit, and a temporary connector operable to removably connect the guidance and driving unit to the piece of_equipment, and wherein the guidance and driving unit is operable to lift and lower the vertical_leg.

6. The apparatus as claimed in claim 5, further comprising a set of foot-pieces at the bearing points of the lifting units on the seabed, wherein the foot-pieces have lateral surfaces for guiding the ship's hull as it moves between the lifting units.

7. The method as claimed in claim 5, wherein each lifting unit comprises a leg equipped with a rack, the leg being constructed and configured to bear down upon the seabed; and a leg guidance and driving device, detachably mounted on the piece of equipment and comprising at least one pinion which meshes with the rack, and a motor reduction unit for driving the pinion in order to move the leg with respect to the guidance and driving unit.

* * * * *